US011692243B2

(12) United States Patent
Jeon et al.

(10) Patent No.: US 11,692,243 B2
(45) Date of Patent: Jul. 4, 2023

(54) FREE-CUTTING LEADLESS COPPER ALLOY WITH NO LEAD AND BISMUTH

(71) Applicant: Poongsan Corporation, Pyeongtaek-Si (KR)

(72) Inventors: Bo Min Jeon, Ulsan (KR); Won Seok Jeong, Ulsan (KR); Won Shin Kwak, Ulsan (KR)

(73) Assignee: Poongsan Corporation, Pyeongtaek-Si (KR)

( * ) Notice: Subject to any disclaimer, the term of this patent is extended or adjusted under 35 U.S.C. 154(b) by 503 days.

(21) Appl. No.: 16/495,351

(22) PCT Filed: Jun. 4, 2019

(86) PCT No.: PCT/KR2019/006698
§ 371 (c)(1),
(2) Date: Sep. 18, 2019

(87) PCT Pub. No.: WO2020/130247
PCT Pub. Date: Jun. 25, 2020

(65) Prior Publication Data

US 2021/0363613 A1 Nov. 25, 2021

(30) Foreign Application Priority Data

Dec. 19, 2018 (KR) ..... 10-2018-0165425

(51) Int. Cl.
*C22C 9/04* (2006.01)
*C22F 1/08* (2006.01)

(52) U.S. Cl.
CPC . *C22C 9/04* (2013.01); *C22F 1/08* (2013.01)

(58) Field of Classification Search
CPC ..... C22C 9/04; C22F 1/08
See application file for complete search history.

(56) References Cited

U.S. PATENT DOCUMENTS 6,942,742 B2 9/2005 Yamagishi
7,351,372 B2 4/2008 Inohana
2004/0140022 A1* 7/2004 Inohana ..... C22F 1/08 148/553
2014/0112821 A1* 4/2014 Yamamoto ..... C22C 9/04 420/475

(Continued)

FOREIGN PATENT DOCUMENTS

CN 1517446 A 8/2004
CN 1521281 A 8/2004

(Continued)

OTHER PUBLICATIONS

Park Cheol Min, Machine translation of KR-100631041-B1 description, Oct. 4, 2006 (Year: 2006).*

(Continued)

*Primary Examiner* — Nicholas A Wang
*Assistant Examiner* — Maxwell Xavier Duffy
(74) *Attorney, Agent, or Firm* — Loeb & Loeb LLP

(57) ABSTRACT

Disclosed is a high-strength free-cutting leadless copper alloy with excellent machinability and corrosion-resistance. The free-cutting leadless copper alloy contains 58 to 70 wt % of copper (Cu), 0.5 to 2.0 wt % of tin (Sn), 0.1 to 2.0 wt % of silicon (Si), a balance amount of zinc (Zn), and inevitable impurities but does not contain lead.

4 Claims, 2 Drawing Sheets

(56) References Cited

U.S. PATENT DOCUMENTS

2015/0275333 A1* 10/2015 Tameda ..... C22C 9/04
251/368

FOREIGN PATENT DOCUMENTS

| | | | |
|---|---|---|---|
| CN | 102286674 | | 12/2011 |
| CN | 104831115 | A | 8/2015 |
| CN | 103643078 | B | 4/2016 |
| CN | 107974573 | A | 5/2018 |
| CN | 108517440 | | 9/2018 |
| EP | 3109347 | | 12/2016 |
| JP | S59179744 | | 10/1984 |
| JP | S60164198 | A | 8/1985 |
| JP | 2000119775 | | 4/2000 |
| JP | 2001064742 | | 3/2001 |
| JP | 2002155326 | A | 5/2002 |
| KR | 100631041 | B1 * | 10/2006 |
| KR | 20120104963 | | 9/2012 |
| KR | 101337477 | | 12/2013 |
| KR | 101340487 | | 12/2013 |
| TW | 201335391 | A | 9/2013 |
| WO | 2006016621 | A1 | 2/2006 |
| WO | 2017127264 | | 7/2017 |

OTHER PUBLICATIONS

Taiwan Intellectual Property Office, Office action, dated Mar. 11, 2020, 8 pages.

Notice of Rejection for Japanese Application No. 2019-559042 dated Apr. 20, 2021, 12 pages.

First Office Action, CNIPA, Application No. 201980001474.9, dated Apr. 6, 2021 (18 pages).

Search Report for Corresponding European Application No. 19756080.8, dated Jul. 2, 2021, 7 pages.

* cited by examiner

【FIG. 1】
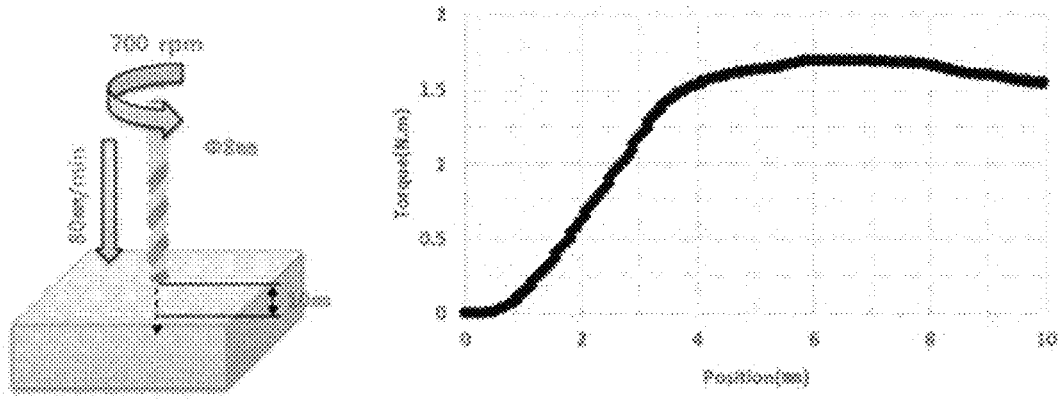
【FIG. 2】
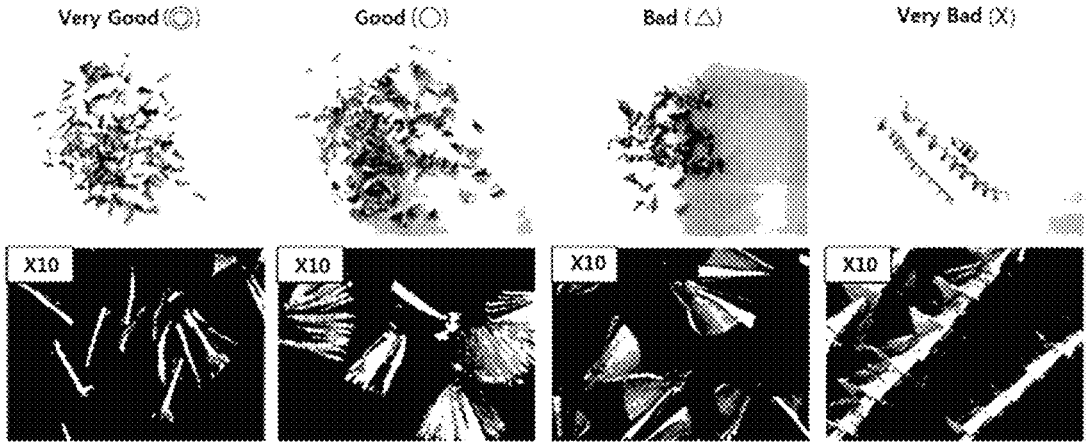
【FIG. 3】
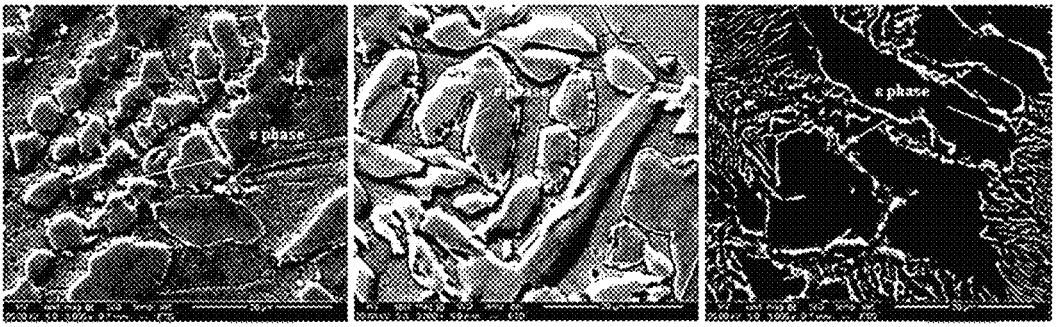
Example 1 Comparative Example 2 Comparative Example 4

【FIG. 4】
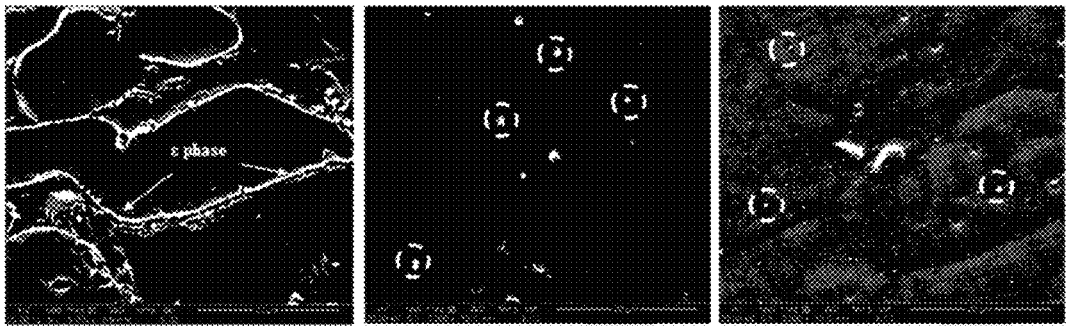
Example 9 Comparative Example 10 Comparative Example 11
【FIG. 5】
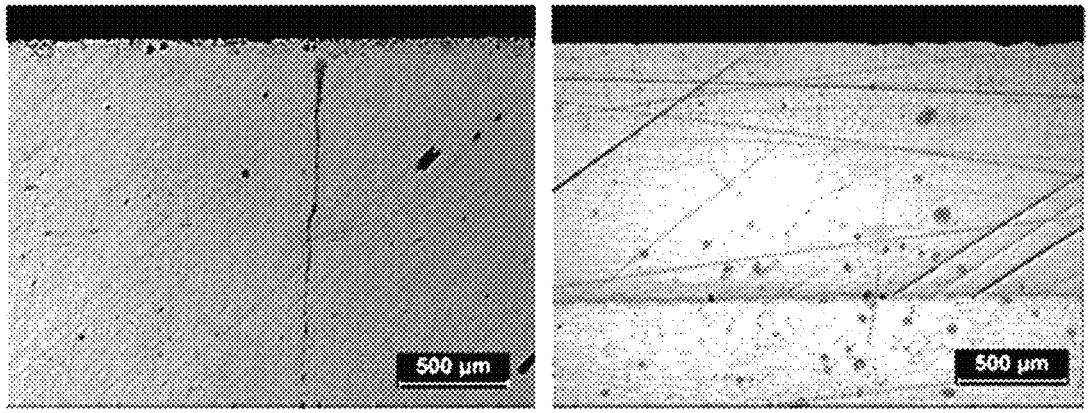
Example 6 Comparative Example 15
【FIG. 6】
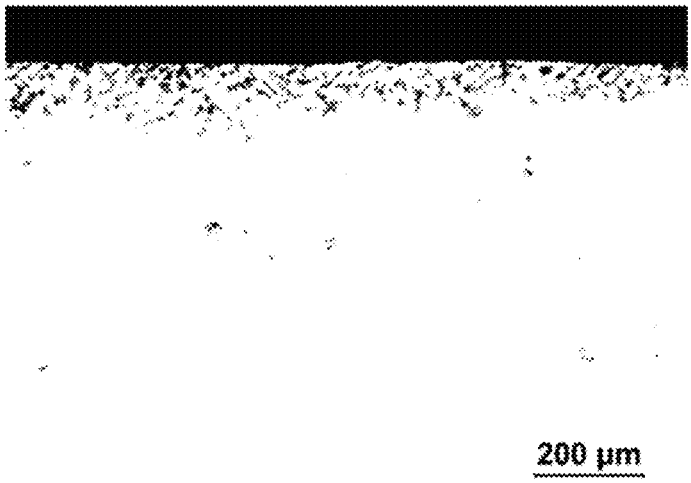
Example 13

FREE-CUTTING LEADLESS COPPER ALLOY WITH NO LEAD AND BISMUTH

CROSS REFERENCE OF RELATED APPLICATIONS

The present application is a US national stage of a PCT international application, Serial no. PCT/KR2019/006698, filed on Jun. 4, 2019, which claims the priority of Korean patent application No. 10-2018-0165425, filed with KIPO of Republic of Korea on Dec. 19, 2018, the entire content of these applications are incorporated into the present application by reference herein.

TECHNICAL FIELD

The present disclosure relates to a free-cutting leadless copper alloy with excellent machinability and corrosion resistance, and more specifically to, a free-cutting leadless copper alloy that does not contain lead and bismuth and contains 58 to 70% by weight of copper (Cu), 0.5 to 2.0% by weight of tin (Sn), 0.1 to 2.0% by weight of silicon (Si), a balance amount of zinc (Zn), and other inevitable impurities.

BACKGROUND

Copper (Cu), which is a non-ferrous metal material, is used by adding various additives thereto based on a purpose of use. In order to increase workability of brass, 1.0 to 4.5 wt % lead (Pb) has added to the brass to secure machinability. Lead (Pb) does not affect a crystal structure of copper (Cu) since copper (Cu) metal has no solid solubility therein. Further, lead (Pb) plays a role of lubrication at a contact interface between a tool and an object to be cut and a role of grinding a cutting chip. Free-cutting brass containing such lead (Pb) has excellent machinability, so that the free-cutting brass containing such lead (Pb) is widely used in valves, bolts, nuts, automobile parts, gears, camera parts, and the like.

However, lead is a hazardous substance that adversely affects human body and environment. As Restriction of Hazardous Substances (RoHS) was enacted in Europe in 2003, environmental regulations became strict and regulations of hazardous elements on the human body were enforced. Thus, use of lead has been regulated. In accordance with such situation, researches have been conducted on a new alloy to replace the free-cutting brass which has improved the machinability by adding lead (Pb).

As a result, leadless brass in which bismuth (Bi) is added to copper (Cu) instead of lead (Pb) was developed. However, a crack due to coarse crystal grains and grain boundary segregation occurs, and therefore, crystal grains have to be refined and spheroidized via heat-treatment. Thus, use of leadless brass containing bismuth (Bi) has been avoided. In addition, bismuth (Bi) is a heavy metal substance such as lead (Pb), although it is not clearly identified as harmful to the human body, and is likely to be selected as a target of the same regulation as lead in the future.

Recently, in the United States, lead (Pb) content in a copper alloy for a faucet is greatly restricted. Further, it is expected that the lead (Pb) content will be more restricted mainly in advanced countries in the future. In case of a conventional copper alloy that does not contain lead, due to a lack of the machinability, the conventional copper alloy is not able to be used as a free-cutting material. Therefore, development of leadless free-cutting copper alloy is strongly needed.

In one example, the free-cutting copper alloy is not able to be used in a product involving fluids such as the faucet, valve, meter part, or the like due to poor corrosion-resistance. To solve this problem, the free-cutting copper alloy is used by plating with Ni or the like, but the plating is not permanent, and there is still a problem in which internal copper alloy is rapidly corroded after the plating is exfoliated.

In addition, the free-cutting copper alloy is difficult to be used in a product requiring high strength because lead (Pb) and bismuth (Bi) are not solid-solved in a microstructure, and thus strength is not secured.

In order to solve the above problems, development of a leadless free-cutting copper alloy having excellent machinability and having excellent corrosion-resistance simultaneously is required.

Korean patent application publication No. 10-2012-0104963 discloses a leadless free-cutting copper alloy containing 65 to 75% of copper (Cu), 1 to 1.6% of silicon (Si), 0.2 to 3.5% of aluminum (Al), and the remainder composed of inevitable impurities but not containing bismuth. In general, addition of aluminum (Al) in the copper alloy is effective in improving the strength and corrosion-resistance. However, the copper alloy of the above-mentioned patent document increases a β-phase fraction due to a high zinc equivalent by adding aluminum up to 3.5% and increases brittleness and strength. Thus, it is difficult to secure workability.

Korea Patent Publication No. 10-2001-0033101 discloses a free-cutting copper alloy containing 69 to 79% of copper (Cu), 2 to 4% of silicon (Si), 0.02 to 0.04% of lead (Pb), and zinc (Zn). The copper alloy of the above-mentioned patent document contains lead and improves machinability by forming a γ-phase in a metal microstructure. However, when 3% or above of silicon (Si) having a high melting point and small specific gravity is added, a large amount of silicon oxide is generated, making it difficult to produce high quality ingot. In addition, since 69% or above of copper (Cu) is required to form the γ-phase, a raw material cost is excessive as compared to the conventional free-cutting copper alloy.

Korean patent application publication No. 10-2013-0035439 discloses a free-cutting leadless copper alloy containing 56 to 77% of copper (Cu), 0.1 to 3.0% of manganese (Mn), 1.5 to 3.5% of silicon (Si), 0.1 to 1.5% of calcium (Ca), and zinc (Zn). Machinability is improved by adding calcium. However, due to a high oxidative property of calcium, a large amount of oxide is generated during an air casting process, and it is difficult to produce high quality ingot because it is difficult to secure target components.

DISCLOSURE

Technical Purpose

The present disclosure aims to provide a copper alloy with excellent machinability and corrosion-resistance without containing lead (Pb) or bismuth (Bi) components.

Technical Solution

In a first aspect of the present disclosure, there is provided a free-cutting leadless copper alloy containing: 58 to 70 wt % of copper (Cu), 0.5 to 2.0 wt % of tin (Sn), 0.1 to 2.0 wt % of silicon (Si), a balance amount of zinc (Zn), and inevitable impurities, wherein a sum of contents of tin (Sn) and silicon (Si) is 1.0 wt %≤Sn+Si≤3.0 wt %.

In one implementation of the first aspect, the free-cutting leadless copper alloy may further contain 0.04 to 0.20 wt % of phosphorus (P). Further, the free-cutting leadless copper alloy may further contain less than 0.2 wt % of aluminum (Al). Further, the free-cutting leadless copper alloy may further contain less than 0.1 wt % of nickel (Ni) or manganese (Mn).

In one implementation of the first aspect, the free-cutting leadless copper alloy may include all of α-phase, β-phase, and ε-phase. An area percentage of the ε-phase is 3 to 20% in a metal matrix of the copper alloy.

In a second aspect of the present disclosure, there is provided a method for producing the free-cutting leadless copper alloy of the present disclosure described above including: performing heat-treatment at a temperature of 450 to 750° C. for 30 minutes to 4 hours.

Technical Effect

The free-cutting leadless copper alloy according to the present disclosure has the machinability and the corrosion-resistance. In addition, all elements added to the free-cutting leadless copper alloy of the present disclosure are eco-friendly and are capable of adequately replacing conventionally used free-cutting brass containing lead and bismuth.

BRIEF DESCRIPTION OF THE DRAWINGS

FIG. 1 shows conditions of a machinability test and a graph of a test result of Example 2.

FIG. 2 shows photos of categorized shapes of cutting chips formed by a drilling process.

FIG. 3 is scanning electron microscopy photos showing microstructures in which ε-phases of Example 1, Comparative Example 2, and Comparative Example 4 are distributed, respectively.

FIG. 4 is scanning electron microscopy photos showing a microstructure of Example 9 and microstructures of Comparative Examples 9 and 10 in which intermetallic compounds are distributed, respectively.

FIG. 5 is optical microscopy photographs showing results of a dezincification test of Example 6 and Comparative Example 15, respectively.

FIG. 6 is an optical microscopy photo showing a result of a dezincification test of Example 13.

DETAILED DESCRIPTIONS

Hereinafter, the present disclosure will be described in more detail. However, a following description should be understood only as an optimal embodiment for the implementation of the present disclosure. The scope of the present disclosure is construed as being covered by the scope of the appended claims.

The present disclosure discloses a free-cutting leadless copper alloy containing 58 to 70 wt % of copper (Cu), 0.5 to 2.0 wt % of tin (Sn), 0.1 to 2.0 wt % of silicon (Si), a balance amount of zinc (Zn), and inevitable impurities, wherein a sum of the contents of tin (Sn) and silicon (Si) is 1.0 wt %≤Sn+Si≤3.0 wt %.

In the copper alloy according to the present disclosure, since tin (Sn) and silicon (Si) are added to a Cu—Zn alloy, a ε-phase is dispersed and produced in a metal microstructure, thereby showing improved machinability.

Specific meanings of the composition and content of the free-cutting leadless copper alloy according to the present disclosure are as follows.

(1) Copper (Cu): 58 to 70 wt %

In the free-cutting leadless copper alloy according to the present disclosure, copper (Cu), which is a main component of the copper alloy, forms α-, β-, and ε-phase microstructures with zinc and additive elements depending on contents of zinc (Zn) and the additive elements to improve machinability and workability. The content of copper in the free-cutting leadless copper alloy according to the present disclosure is 58 to 70 wt %. When the content of copper (Cu) is below 58 wt %, the ε-phase and the β-phase are excessively generated, which lowers cold workability, increases brittleness, and further deteriorates corrosion-resistance. When the copper (Cu) content is above 70 wt %, not only a price of a raw material is increased but also the machinability is not secured sufficiently since a formation of the ε-phase is insufficient and the soft α-phase is excessively generated.

(2) Tin (Sn): 0.5 to 2.0 wt %

In the free-cutting leadless copper alloy according to the present disclosure, tin (Sn) contributes to the formation of the ε-phase and increases a size and a fraction of the ε-phase to improve the machinability and to improve the corrosion-resistance such as dezincification corrosion-resistance. In the copper alloy of the present disclosure, the content of tin (Sn) is in a range of 0.5 to 2.0 wt %. When the tin content is below 0.5 wt %, the formation of the ε-phase is insufficient. Therefore, tin does not contribute to the improvement of the machinability and the effect of the corrosion-resistance improvement may not be obtained. When the tin content is above 2.0 wt %, a material is cured, the ε-phase is coarsened, and the fraction of the ε-phase is increased, thereby adversely affecting the cold workability and the machinability.

(3) Silicon (Si): 0.1 to 2.0 wt %

In the free-cutting leadless copper alloy according to the present disclosure, silicon (Si) promotes the ε-phase formation and improves the corrosion-resistance. In the free-cutting leadless copper alloy according to the present disclosure, the silicon (Si) content is in a range of 0.1 to 2.0 wt %. When the content of silicon (Si) is below 0.1 wt %, silicon (Si) does not contribute to promote the ε-phase generation and to improve the corrosion-resistance. As the silicon (Si) content increases, an amount of the ε-phase is increased and the machinability is improved. However, when the silicon (Si) content is above 2.0 wt %, the ε-phase is excessively generated. Thus, a finally produced copper alloy is cured to lower the machinability improvement effect and adversely affect the castability and the cold workability.

(4) Zinc (Zn): Balance

Zinc forms the Cu—Zn-based alloy with copper (Cu), contributes to the formation of α-, δ- and ε-phase microstructures depending on the added content, and affects the castability and the workability. In the present disclosure, Zinc is added as the balance. When the zinc content is too high, a product is cured to not only increase the brittleness but also reduce the corrosion-resistance. On the other hand, when the zinc content is too low, the α-phase is excessively formed, resulting in a deterioration in the machinability.

(5) Range of the Sum of Tin (Sn) and Silicon (Si)

The sum of the contents of tin (Sn) and silicon (Si) should satisfy 1.0 wt %≤Sn+Si≤3.0 wt %. When the sum of silicon and tin is below 1.0 wt %, the formation of the ε-phase is insufficient, and thus does not show a great effect on improving the machinability and the corrosion-resistance.

When the sum of the contents of tin (Sn) and silicon (Si) is above 3.0 wt %, the ε-phase is coarsened, the fraction of the ε-phase is increased, and the product is cured, thereby adversely affecting cutting workability and the cold workability.

(6) Phosphorus (P): 0.04 to 0.20 wt %

The free-cutting leadless copper alloy according to the present disclosure may further include phosphorus (P). Phosphorus (P) improves the corrosion-resistance by α-phase stabilization and microstructure refinement, and improves fluidity of molten metal by acting as a deoxidizer during casting. When phosphorus is included, the content of phosphorus is 0.04 to 0.20 wt %. When the content of phosphorus (P) is below 0.04 wt %, there is almost no effect of improving the microstructure refinement and corrosion-resistance. When the content of phosphorus (P) is above 0.20 wt %, there is a limit in the microstructure refinement, the hot workability is lowered, a Si—P-based compound is formed together with silicon (Si) to improve a hardness, and solid solubility of Si in the microstructure is reduced to deteriorate the corrosion-resistance.

(7) Aluminum (Al): Less than 0.2 wt %

Aluminum (Al) generally improves the corrosion resistance and flowability of the molten metal. However, in the present disclosure, since aluminum (Al) deteriorates the cold workability and suppresses the formation of the ε-phase, thereby deteriorating the machinability, addition of aluminum (Al) is limited to below 0.2 wt %. The addition of aluminum (Al) of below 0.2 wt % does not significantly affect the machinability of the alloy of the present disclosure.

(8) Nickel (Ni) and Manganese (Mn): Respectively Below 0.1 wt %

Nickel (Ni) and manganese (Mn) have an effect of improving a strength by forming a fine compound with a solid solution element and other elements. However, in the present disclosure, a Ni—Si-based compound or a Mn—Si-based compound are produced to consume Si, thereby reducing the machinability and the corrosion-resistance. In addition, since manganese (Mn) reduces a dezincification property, each of addition amounts of nickel (Ni) and manganese (Mn) is limited to below 0.1 wt %. When nickel and manganese are added in a small amount of below 0.1 wt %, nickel and manganese do not significantly affect formation and property of the compound of the free-cutting leadless copper alloy according to the present disclosure.

(9) Inevitable Impurities

The inevitable impurities are elements which are inevitably added in a producing process. The inevitable impurities include, for example, iron (Fe), chromium (Cr), selenium (Se), magnesium (Mg), arsenic (As), antimony (Sb), cadmium (Cd), and the like. The total content of the inevitable impurities is controlled to be equal to or below 0.5 wt %, and the inevitable impurities do not significantly affect a property of the copper alloy in the above mentioned range of the content.

The free-cutting leadless copper alloy according to the present disclosure contains the ε-phase. In this case, the formation of the ε-phase improves strength and abrasion resistance, and the ε-phase acts as a chip breaker to improve the machinability. A percentage of an area of the ε-phase is 3 to 20% in a metal matrix of the copper alloy. However, when the percentage of the area of the ε-phase is below 3% in the metal matrix of the copper alloy, the machinability of an industrially usage degree may not be sufficiently secured. Further, when the percentage of the area of the ε-phase is above 20% in the metal matrix of the copper alloy, the strength and brittleness of the copper alloy material increases rapidly, which adversely affects the machinability and workability. The percentage of the area of the ε-phase may be reduced or increased by a heat-treatment at 450 to 750° C. for 30 minutes to 4 hours as needed to secure the machinability.

Method for Producing the Free-Cutting Leadless Copper Alloy According to the Present Disclosure The free-cutting leadless copper alloy according to the present disclosure may be produced according to a following method.

The alloy components of the free-cutting leadless copper alloy according to the present disclosure described above is melted at a temperature of about 950 to 1050° C. to produce the molten metal. The molten metal is maintained for a predetermined time, for example, 20 minutes, and then casted. Since the component of the copper alloy according to the present disclosure contains rather a lot of oxide during the casting, it is preferable to perform the casting after removing the oxide of the molten metal as much as possible after the melting.

An ingot produced by the casting process is cut to a certain length, heated at 500 to 750° C. for 1 to 4 hours, hot extruded at a strain percentage of equal to or above 70%, and then an oxide film on a surface thereof is removed via a pickling process.

A hot material obtained from the above is cold worked using a drawing machine to have a desired diameter and tolerance. Thereafter, a heat-treatment may be performed at 450 to 750° C. for 30 minutes to 4 hours as needed. The ε-phase is also generated by the hot extrusion. In this case, when the ε-phase fraction is smaller or larger than a target fraction, the ε-phase fraction may be adjusted to a target level via an additional heat-treatment. The corresponding heat-treatment step may be omitted when a product of a good quality is obtained via the hot extrusion step. When the heat-treatment is performed at a temperature below 450° C. or less than 30 minutes, insufficient heating results in poor phase transformation of the ε-phase. When the heat-treatment is performed at a temperature above 750° C. or more than 4 hours, β-phase overproduction and microstructure coarsening result in reduction of the machinability and the cold workability.

Thereafter, those skilled in the art may add a necessary processing such as repeatedly realizing the heat-treatment and drawing process, processing to a required specification, securing straightness using a straightener, or the like.

EXAMPLES

Table 1 shows compositions of Examples and Comparative Examples of the present disclosure. In the present disclosure, an ingot was casted based on the composition shown in Table 1 and specimens of copper alloys of Examples and Comparative Examples were produced via the hot extrusion process or the like to evaluate properties of the obtained copper alloy specimens based on a test scheme to be described below.

Examples 1 to 19

Specifically, alloy components were melted at a temperature of about 1000° C. based on each composition described in Table 1 to produce molten metal, the molten steel was melted and oxide in the molten metal was removed as much as possible, the molten metal was maintained for 20 minutes, and then casted into specimens according to Examples 1 to 19 of a diameter of 50 mm. The ingot produced by the casting process was cut to a certain length, heated at 650° C. for 2 hours, hot extruded to a diameter of 14 mm (strain percentage of 71%), and then 95% or above of an oxide film thereof was removed via the pickling process.

The hot material obtained from the above was cold-worked using the drawing machine to have a diameter in a range of 12.96 to 13.00 mm.

TABLE 1

| Classification | Content (Wt %) | | | | | | | | | |
|---|---|---|---|---|---|---|---|---|---|---|
| | Cu | Zn | Si | Sn | Si + Sn | P | Al | Ni | Mn | Pb |
| Example 1 | 62.4 | Bal. | 1.27 | 1.22 | 2.49 | — | — | — | — | — |
| Example 2 | 65.5 | Bal. | 1.90 | 0.50 | 2.40 | — | — | — | — | — |
| Example 3 | 58.5 | Bal. | 1.40 | 1.10 | 2.50 | 0.04 | — | — | — | — |
| Example 4 | 68.0 | Bal. | 1.70 | 1.30 | 3.00 | — | — | — | — | — |
| Example 5 | 65.7 | Bal. | 0.10 | 2.00 | 2.10 | 0.04 | — | — | — | — |
| Example 6 | 61.7 | Bal. | 1.48 | 0.56 | 2.04 | 0.05 | — | — | — | — |
| Example 7 | 63.0 | Bal. | 1.48 | 1.23 | 2.71 | — | — | — | — | — |
| Example 8 | 60.0 | Bal. | 1.01 | 0.50 | 1.51 | — | — | — | — | — |
| Example 9 | 58.0 | Bal. | 1.00 | 1.00 | 2.00 | 0.05 | — | — | — | — |
| Example 10 | 59.2 | Bal. | 0.97 | 0.50 | 1.47 | 0.06 | — | — | — | — |
| Example 11 | 59.0 | Bal. | 1.25 | 1.00 | 2.25 | 0.06 | — | — | — | — |
| Example 12 | 66.9 | Bal. | 1.82 | 0.53 | 2.35 | 0.11 | — | — | — | — |
| Example 13 | 65.8 | Bal. | 0.76 | 0.78 | 1.54 | 0.14 | — | — | — | — |
| Example 14 | 68.0 | Bal. | 1.80 | 0.50 | 2.30 | — | — | — | — | — |
| Example 15 | 65.6 | Bal. | 1.70 | 0.70 | 2.40 | 0.15 | — | — | — | — |
| Example 16 | 64.0 | Bal. | 0.98 | 0.99 | 1.97 | — | 0.08 | — | — | — |
| Example 17 | 59.5 | Bal. | 1.18 | 1.04 | 2.22 | — | 0.16 | — | — | — |
| Example 18 | 59.2 | Bal. | 0.99 | 1.01 | 2.00 | — | — | 0.02 | — | — |
| Example 19 | 60.0 | Bal. | 0.77 | 1.02 | 1.79 | — | — | — | 0.03 | — |

Comparative Examples 1 to 17

Each specimen was produced in a same manner as the method for producing the specimens of Examples 1 to 19 described above, based on compositions of Comparative Examples 1 to 17 described in Table 2.

In one example, in Table 2, Comparative Example 15 is a JIS C3604, a free-cutting brass, Comparative Example 16 is a JIS C3771, a forging brass, and Comparative Example 17 is a JIS C4622, a naval brass with excellent corrosion-resistance.

TABLE 2

| Classification | Content (Wt %) | | | | | | | | | |
|---|---|---|---|---|---|---|---|---|---|---|
| | Cu | Zn | Si | Sn | Si + Sn | P | Al | Ni | Mn | Pb |
| Comparative Example 1 | 68.6 | Bal. | 2.18 | 0.41 | 2.59 | — | — | — | — | — |
| Comparative Example 2 | 62.2 | Bal. | 0.55 | 0.40 | 0.95 | — | — | — | — | — |
| Comparative Example 3 | 70.5 | Bal. | 1.00 | 0.60 | 1.60 | — | — | — | — | — |
| Comparative Example 4 | 60.7 | Bal. | 1.56 | 1.70 | 3.26 | — | — | — | — | — |
| Comparative Example 5 | 69.0 | Bal. | 0.00 | 1.90 | 1.90 | — | — | — | — | — |
| Comparative Example 6 | 64.4 | Bal. | 1.98 | 0.04 | 2.02 | — | — | — | — | — |
| Comparative Example 7 | 59.5 | Bal. | 0.94 | 0.73 | 1.69 | — | 0.23 | — | — | — |
| Comparative Example 8 | 59.3 | Bal. | 1.48 | 0.56 | 2.04 | — | — | 0.11 | — | — |
| Comparative Example 9 | 58.1 | Bal. | 0.95 | 1.14 | 2.09 | — | — | 0.17 | — | — |
| Comparative Example 10 | 65.0 | Bal. | 2.00 | 0.87 | 2.87 | — | — | — | 0.13 | — |
| Comparative Example 11 | 57.5 | Bal. | 1.87 | 0.90 | 2.77 | — | — | — | — | — |
| Comparative Example 12 | 66.0 | Bal. | 0.70 | 2.20 | 2.90 | — | — | — | — | — |
| Comparative Example 13 | 66.5 | Bal. | 1.90 | 0.50 | 2.40 | 0.23 | — | — | — | — |
| Comparative Example 14 | 67.7 | Bal. | 2.00 | 0.52 | 2.52 | 0.41 | — | — | — | — |
| Comparative Example 15 (JIS C3604) | 59.2 | Bal. | — | — | 0.00 | — | — | — | — | 3.4 |

TABLE 2-continued

| Classification | Content (Wt %) | | | | | | | | | |
|---|---|---|---|---|---|---|---|---|---|---|
| | Cu | Zn | Si | Sn | Si + Sn | P | Al | Ni | Mn | Pb |
| Comparative Example 16 (JIS C3771) | 58.5 | Bal. | — | — | 0.00 | — | — | — | — | 2.0 |
| Comparative Example 17 (JIS C4622) | 61.0 | Bal. | — | 1.00 | 1.00 | — | — | — | — | — |

Test Example (1) Machinability Test (Cutting Torque and Chip Shape)

Machinability of the copper alloy was evaluated by the cutting torque and the chip shape.

First, as shown in FIG. 1, a machinability testing machine was used to measure and evaluate a torque transmitted to a drill tool during drilling. During cutting, a size of a cutting drill was 18 mm, a rotation speed thereof was 700 rpm, a moving speed thereof was 80 mm/min, a moving distance thereof was 10 mm, a moving direction thereof was a gravity direction, and torque average values (in units of N·m) of 4 to 10 mm cutting section were described in Tables 3 and 4 to be described below. A high cutting torque means that a cutting workability is low and a small cutting torque means that the cutting workability is high because less force is required even when machining the same depth. A machinability test result of the specimen of Example 2 is shown in a graph on a right side of FIG. 1.

In addition, shapes of the chips formed in the drilling process described above were observed and shown in Tables 3 and 4. A criteria for determining the machinability are shown in FIG. 2. That is, the shapes of the cutting chips are divided into four categories: very good (◎), good (○), bad (Δ), and very bad (X). In this connection, the shapes of the chips corresponding to the very good (◎) and the good (○) are excellent in dispersibility and chip dischargeability, and are suitable for use in an industrial field. However, the shapes of the cutting chips corresponding to the bad (Δ) and the very bad (X) are not suitable for use in the industrial field because cutting surface and cutting tool are damaged and the chip dischargeability is poor.

As shown in Tables 3 and 4 below, it was identified that the specimens produced in Examples 1 to 19 have machinability far superior to Comparative Example 17 (C4622) that does not contain lead in comparison of the cutting torque and the chip shape. In addition, it was identified that the machinability of the copper alloys produced according to Examples of the present disclosure is equal to or similar as Comparative Example 15 (C3604) and Comparative Example 16 (C3771), which are the conventional alloys containing lead.

In one example, although the specimen of Comparative Example 2 contains silicon and tin, since the content of silicon (Si)+tin (Sn) is less than 1 wt %, it may be identified that machinability is not improved (Table 4). In this regard, referring to FIG. 3, although each of the contents of silicon and tin is in a range of content defined in the present disclosure, when the content of silicon (Si)+tin (Sn) is less than 1 wt %, it is determined that the ε-phase is below 3% and therefore is insufficient to improve the machinability. Also, as shown in FIG. 3, it is identified that excessive ε-phase of equal to or above 20% is formed in the specimen of Comparative Example 4 added with more than 3 wt % of the content of silicon (Si)+tin (Sn). Such the excessive formation of the ε-phase rather reduced the workability and the machinability. This was also identified in a result of a machinability test of Table 4.

In Comparative Example 7, it was identified that when the aluminum (Al) content is above 0.2 wt %, the formation of the ε-phase is suppressed to reduce the machinability. In Comparative Examples 8 to 10, it was identified that when the content of manganese (Mn) or nickel (Ni) is above 0.1 wt %, manganese and nickel form Mn—Si-based and Ni—Si-based compounds. Further, it was identified that consumption of silicon (Si) based on the formation of the compounds reduces the formation of the ε-phase to reduce the machinability. In this regard, referring to FIG. 4, it may be seen that the specimens according to Comparative Example 9 and Comparative Example 10 form the Mn—Si-based and Ni—Si-based compounds (dotted circles).

(2) Microstructure Image Observation

Microstructure images of the specimens obtained according to Examples and Comparative Examples described above were identified using an optical microscopy and a scanning electron microscopy.

(3) Dezincification Corrosion Test

A corrosion-resistance of the copper alloy specimen was measured by measuring an average dezincification corrosion depth using a KS D ISO6509 (Corrosion of metals and alloys—a dezincification corrosion test of brass) method. The dezincification corrosion is a phenomenon in which zinc is selectively removed from brass alloy due to dealloy or selective leaching corrosion. In general, for example, excellent anti-dezincification corrosion is required in brass for water pipe materials. An acceptance criteria for the dezincification corrosion test of leadless anti-corrosion brass for water pipe materials in Korea is 300 μm on average. It is evaluated that when the dezincification depth is equal to or below 300 μm, the corrosion-resistance is excellent.

In order to measure the dezincification depth based on KS D ISO6509 for specimens according to the Examples and Comparative Examples, each specimen surface was polished up to 2000 times with a polishing paper, ultrasonically washed with pure water, and then dried. The washed specimens were immersed in 1% $CuCl_2$ aqueous solution, heated at a temperature of 75° C., maintained for 24 hours, and then maximum dezincification depths thereof were measured. Results obtained are shown in Tables 3 and 4.

In the results of the dezincification corrosion test of Table 3, it was identified that all of the specimens according to Examples 1 to 19 of the present disclosure are equal to or below 300 μm and have properties of leadless anti-corrosion brass.

In comparison of the dezincification depth results of Table 3 and Table 4, it was identified that the specimens according to Examples 1 to 19 of the present disclosure have corrosion-resistance superior to that of Comparative Example 15 (C3604) and Comparative Example 16 (C3771), which are conventional alloys containing lead. It was identified that the specimens according to Examples of the present disclosure have much superior corrosion-resistance even in comparison with Comparative Example 17 (C4622), which has the highest corrosion-resistance among the conventional copper alloys.

In this regard, FIG. 5 shows results of the dezincification corrosion test of Example 6 and Comparative Example 15 (C3604). From FIG. 5, it may identified that a dezincification depth of the specimen according to Example 6 is much smaller than a dezincification depth of the specimen according to Comparative Example 15, which indicates that dezincification corrosion of the specimen according to Example 6 is superior to that of the specimen according to Comparative Example 15.

In addition, in comparison of Example 1 and Comparative Example 2 respectively disclosed in Tables 3 and 4, it may be identified that the addition of tin (Sn) and silicon (Si) decreases the dezincification depth. Further, in comparison of Example 7 and Comparative Example 6, it may be identified that especially as an addition amount of tin (Sn) increases, the dezincification corrosion of the alloy increases.

In addition, FIG. 6 is a result of the dezincification corrosion test of Example 13. It was identified that a β-phase is selectively corroded. That is, it was identified that, in Example 13, addition of phosphorus (P) enhanced an α-phase in the obtained specimen to improve corrosion-resistance.

(4) Hardness Test

Hardness of the copper alloy was measured by applying a load of 1 kg using a Vickers hardness tester. In results of hardness (Hv) measurement of Table 3 and Table 4, it was identified that the copper alloy specimens of Examples 1 to 19 have hardness higher than that of Comparative Example 15 (C3604), Comparative Example 16 (C3771), and Comparative Example 17 (C4622), which are the conventional alloys.

TABLE 3

| Classification | Cutting torque (N · m) | Chip shape | Dezincification depth (μm) | Hardness (Hv) |
|---|---|---|---|---|
| Example 1 | 1.41 | ◎ | 0 | 215 |
| Example 2 | 1.60 | ○ | 246 | 196 |
| Example 3 | 1.52 | ◎ | 92 | 226 |
| Example 4 | 1.98 | ○ | 117 | 156 |
| Example 5 | 1.76 | ○ | 0 | 243 |
| Example 6 | 1.58 | ◎ | 32 | 194 |
| Example 7 | 1.64 | ○ | 110 | 194 |
| Example 8 | 1.62 | ○ | 194 | 207 |
| Example 9 | 1.76 | ○ | 135 | 197 |
| Example 10 | 1.50 | ◎ | 194 | 188 |
| Example 11 | 1.48 | ◎ | 91 | 221 |
| Example 12 | 1.54 | ◎ | 181 | 165 |
| Example 13 | 1.62 | ○ | 130 | 175 |
| Example 14 | 1.89 | ○ | 164 | 159 |
| Example 15 | 1.68 | ○ | 169 | 200 |
| Example 16 | 1.64 | ○ | 92 | 186 |
| Example 17 | 1.64 | ◎ | 150 | 217 |
| Example 18 | 1.64 | ○ | 130 | 197 |
| Example 19 | 1.76 | ○ | 184 | 190 |

TABLE 4

| Classification | Cutting torque (N · m) | Chip shape | Dezincification depth (μm) | Hardness (Hv) |
|---|---|---|---|---|
| Comparative Example 1 | 2.33 | Δ | 158 | 206 |
| Comparative Example 2 | 3.33 | X | 308 | 156 |
| Comparative Example 3 | 2.80 | X | 201 | 128 |
| Comparative Example 4 | 2.50 | Δ | 25 | 246 |
| Comparative Example 5 | 3.22 | X | 35 | 240 |
| Comparative Example 6 | 2.55 | Δ | 347 | 212 |
| Comparative Example 7 | 2.60 | X | 181 | 209 |
| Comparative Example 8 | 2.53 | Δ | 169 | 247 |
| Comparative Example 9 | 2.40 | X | 103 | 227 |
| Comparative Example 10 | 2.50 | Δ | 305 | 222 |
| Comparative Example 11 | 3.40 | Δ | 198 | 168 |
| Comparative Example 12 | 3.22 | Δ | 94 | 232 |
| Comparative Example 13 | 2.97 | X | 139 | 204 |
| Comparative Example 14 | Occurrence of hot extrusion crack | | | |
| Comparative Example 15 | 1.40 | ◎ | 1100 | 110 |
| Comparative Example 16 | 1.50 | ◎ | 1000 | 110 |
| Comparative Example 17 | 3.20 | X | 400 | 140 |

Therefore, it was identified that the free-cutting leadless copper alloys according to the present disclosure have high hardness while achieving excellent machinability and corrosion-resistance simultaneously.

INDUSTRIAL AVAILABILITY

As mentioned above, the free-cutting leadless copper alloy according to the present disclosure may be used in a product requiring high strength and excellent machinability and corrosion-resistance.

What is claimed is:

1. A leadless copper alloy consisting of:

58 to 70 wt % of copper (Cu), 0.5 to 2.0 wt % of tin (Sn), 0.1 to 2.0 wt % of silicon (Si), a balance amount of zinc (Zn), and inevitable impurities, and 0.04 to 0.20 wt % of phosphorus (P), less than 0.2 wt % of aluminum (Al), less than 0.1 wt % of nickel (Ni) or less than 0.1 wt % of manganese (Mn), wherein a sum of contents of tin (Sn) and silicon (Si) is 1.0 wt %≤Sn+Si≤3.0 wt %, wherein the inevitable impurities are selected from the group consisting of iron (Fe), chromium (Cr), selenium (Se), magnesium (Mg), arsenic (As), antimony (Sb), cadmium (Cd), and the combination thereof, wherein the sum of the inevitable impurities are equal to or below 0.5 wt %, and wherein the copper alloy comprises a machinability value of 1.41 to 1.98 N·m of torque average values in 4 to 10 mm cutting section after subjecting to a machinability test performed by a machinability testing machine, wherein the machinability test comprises at least one of the following conditions: a size of a cutting drill is ϕ8 mm, a rotation speed thereof is 700 rpm, a moving speed thereof is 80 mm/min, a moving distance thereof is 10 mm, a moving direction thereof is a gravity direction, and torque average values (in units of N·m) of 4 to 10 mm cutting section, and wherein the copper alloy is prepared with no addition of bismuth and wherein the copper alloy is in a bar shape.

2. The leadless copper alloy of claim 1, comprising a-phase, β-phase, and ε-phase.

3. The leadless copper alloy of claim 2, wherein an area percentage of the ε-phase is 3 to 20% in a metal matrix of the copper alloy.

4. A method for producing the leadless copper alloy of claim 1, the method comprising:

performing heat-treatment at a temperature of 450 to 750° C. for 30 minutes to 4 hours.

* * * * *